United States Patent [19]

Van Blokland et al.

[11] 4,365,793

[45] Dec. 28, 1982

[54] SHEET FILM FEEDER

[75] Inventors: Gerardus J. Van Blokland; Henry J. Bailey, both of Fairfax, Va.

[73] Assignee: Oldelft Corporation of America, Fairfax, Va.

[21] Appl. No.: 91,702

[22] Filed: Nov. 6, 1979

[51] Int. Cl.[3] ..... B65H 3/06; B65H 1/06

[52] U.S. Cl. ..... 271/3.1; 271/110; 271/114; 271/124; 271/162; 271/165; 354/310; 354/312; 414/411

[58] Field of Search ..... 271/3.1, 18, 8 R, 145, 271/165, 166, 160, 162–164, 110, 111, 114, 116, 124, 265; 414/411; 250/468, 470, 471; 354/310, 312, 315, 316, 319

[56] References Cited

U.S. PATENT DOCUMENTS

| | | | |
|---|---|---|---|
| 3,514,098 | 5/1970 | Ostwald | 271/110 |
| 3,741,537 | 6/1973 | Lange | 271/165 |
| 3,792,264 | 2/1974 | Lacey | 250/470 X |
| 3,916,208 | 10/1975 | Huttner et al. | 250/408 |
| 3,949,979 | 4/1976 | Taylor et al. | 271/165 X |
| 3,961,785 | 6/1976 | Gall | 271/165 X |
| 4,050,687 | 9/1977 | Spence-Bate | 271/3.1 |
| 4,156,568 | 5/1979 | Erikson | 354/312 |

FOREIGN PATENT DOCUMENTS

| | | | |
|---|---|---|---|
| 2714725 | 10/1978 | Fed. Rep. of Germany | 250/468 |

*Primary Examiner*—Bruce H. Stoner, Jr.

[57] ABSTRACT

A hinged-cover holder receives a film storing magazine. A cavity with an upward opening is positioned below the magazine holder. The cavity also has an exit opening with a light-tight closure mechanism. A planar slide is between the magazine and the cavity and when it is moved from between them it opens both the magazine and the cavity in a light-tight manner so that a stack of film sheets in the magazine falls into the cavity. Transport consists of a stacking arm which pushes the film stack against a separate knife and a downward pressing arm which pushes the film stack toward a powered roller beneath the cavity, which is spaced from the separator knife by about the thickness of a film sheet. Rotation of the roller moves the lower-most film sheet between the roller and the separator knife and through the light-tight exit closure.

11 Claims, 13 Drawing Figures

SHEET FILM FEEDER

This invention relates to daylight film handling devices and more particularly to a device for unloading exposed photographs from a magazine into which they were loaded upon exposure and transporting the exposed film into a film processor.

BACKGROUND OF THE INVENTION

The relevant field of this invention is X-ray films in the form of 100 mm sheets of individual films. In the optical system the X-ray image is formed on the anode screen of an X-ray image intensifier. A special camera is mounted on the image intensifier and is integrated electrically in the X-ray circuit at its feed unit.

The camera registers the output phosphor of the X-ray image intensifier on 100×100 mm. sheets of ordinary film. The 100 mm. sheet film camera overcomes the disadvantages attaching to conventional large-size exposure techniques. It combines a significant reduction in handling operations. The use of 100 mm. sheet film, over roll film, means that any number of exposures can be made readily available for processing and diagnostic viewing.

The use of 100 mm. sheet film also opens up the opportunity for introducing labor saving techniques covering all of the steps in handling X-ray films, i.e., exposure, processing, viewing, copying, framing and filing.

For exposure, a removable supply magazine, which can hold up to 150 individual film sheets, facilitates daylight loading of the camera. And, prior to processing, a removable take up magazine that can hold up to 100 film sheets, 100 mm. in size, facilitates daylight unloading of the camera. This system is described in U.S. Pat. No. 3,627,307, which issued on Dec. 14, 1971. Until now, however, a gap has existed in the continum of automatic, daylight film handling. Until the present invention, it has been necessary to unload the exposed films from the take up magazine and load them by hand into the film processor under dark room conditions.

OBJECTS AND STATEMENT OF THE INVENTION

The object of the present invention is to provide the means for unloading the take up magazine in the daylight and transport the film into the processor.

Another object of the invention is to feed the exposed films, one at a time, automatically, in the daylight, into a film processor, after it has been unloaded.

A further object of the invention is to free up the take up magazine so that it may be returned to the camera for further use while the feeder is transporting the film to a film processor in a light-tight manner.

An additional object of the invention is to provide a feeder which is capable of unloading film from both standard and high speed film magazines.

A further important object of the invention is to unload exposed X-ray film in batch from a film magazine and transport the individual sheets, one at a time, to a film processor in the daylight, without exposing the film to the light and without damaging, scratching or stressing the film in any manner that may cause artifacts in the processed film.

Another object of the invention is to provide a feeder which will transport film for processing to a number of different processors.

Another object of the invention is to remove an empty magazine and to insert a full magazine for continuous operation while the feeder is transporting the films individually into a film processor.

These and other objects are achieved in the present invention in which film feeding device for receiving a stack of individual film sheets and feeding the sheets individually to a film processor has a holder for receiving and holding a film storing magazine, a cavity below said holder which has an upward opening for receiving a stack of film sheets from the film storing magazine and an exit opening for discharging said film sheets.

A planar slide is in the holder, between the magazine and the cavity for opening the film storing magazine in a light-tight manner and for opening said upward cavity opening in a light-tight manner. Means are provided for moving said planar slide from between the magazine and the upward cavity opening. A closure is provided for closing said cavity exit in a light-tight manner, and transport means associated with said cavity move the film sheets individually through said exit closure.

Advantageously, the invention includes the following additional features.

Grooves in the sides of the holder guide the slide for opening and closing over said upward cavity opening and means lock said slide in the closed position. A locking slot opens into the groove and an upward biased spring tab is movable between said locking slot and said groove.

A cover is hinged over said slide. A downward biased spring tab is on the underside of said cover. Said spring tab is arranged to engage and retain a first part of a two-part film magazine for retaining the stack of films over said cavity. And an engagement means is on said slide for drawing the second part of the film magazine from under said first part to release the film stack as said cavity is opened by movement of said slide.

Said engagement means may comprise a step in said slide for engaging behind a downward projecting portion of a magazine first part.

Said engagement means may also comprise an upward biased spring on said slide for engaging behind a downward projecting portion of a magazine first part of a different type.

A pair of stops are at the sides of the holder, each having a pair of stop faces in opposite directions in which the stop faces in one direction engage sideways projecting portions of a movable part of a two-part magazine of one type when the magazine is fully received in the holder, and the stop faces in the opposite direction engage a stationary part of a two-part magazine of a second type when the magazine is fully received in the holder.

An interface device at the cavity exit opening provides a light-tight contact with the input to an adjoining film processor.

The transport means comprises a powered roller below the cavity at the cavity exit opening, rotatable in the direction of the cavity exit opening, a stacking arm pivoted from below the cavity towards the interior of the cavity as the planar slide covers over the upward cavity opening and an arm and roller which moves into the cavity as the planar slide covers over the upward cavity opening.

Means are provided for adjusting the speed of rotation of the roller to a speed less than the input speed of an adjoining processor.

A blade at the cavity exit opening limits the space between itself and the roller to about the thickness of an individual film sheet.

A sensor senses the presence of film sheets in the cavity and a switch connected to the sensor relays the film-sensed condition.

A sensor senses the opening of the cavity exit closure by the transport of an individual film sheet and a switch is connected to the sensor for relaying the timing of the film feeder.

A handle is connected to said planar slide and is positioned outside of the holder for drawing the slide out of the holder.

DESCRIPTION OF THE DRAWINGS

These and other features of the invention will now be described in the following detailed description taken together with the drawings in which.

DETAILED DESCRIPTION OF THE INVENTION

Figure 1:
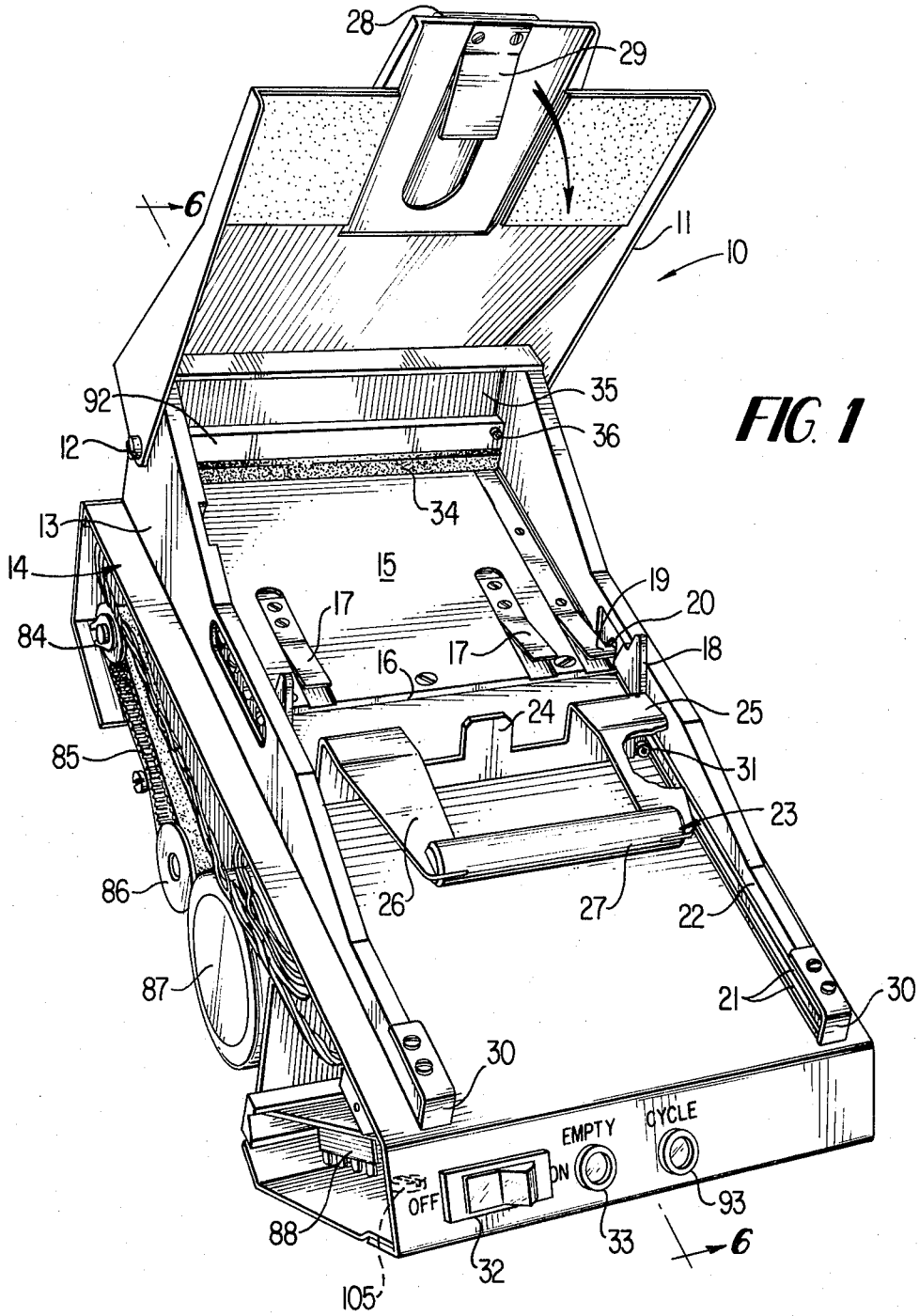
FIG. 1 shows a perspective view of the film handler and feeder in accordance with the invention in which the side cover and bottom plate are removed.

Referring to FIG. 1, the film handler and feeder, shown generally as 10, has a hinged cover or lid 11, mounted by pivot screws 12 to the upstanding sides 13 of the body portion 14 of the film feeder.

With the hinged cover 11 raised in FIG. 1, one can see the darkslide assembly which includes a darkslide 15 fitted to slide in guide channels 21 in the inner walls 22 of the sides 13. Backstops 30 at the end of the guide channels limit the movement of the darkslide in that direction. The backstops 30 extend inward to be contacted by screw 31 which adjusts the limit of movement of the darkslide in the backward direction (towards the viewer in FIG. 1).

The darkslide assembly also includes a pair of spring locking tabs 19 mounted at each side flush on its upper surface and a pair of spring engagement tabs 17 for engagement with a high speed magazine in a manner to be described.

The darkslide 15 is comprised of an upper plate 87 overlapping and fixed by screws to a lower plate 88. The overlapping plates form an upper, rearward facing engagement edge 16 for engagement with a standard take up magazine in a manner to be described. The overlapping plates also form a lower forward looking edge 86. Also included is a darkslide handle 23, having vertical portions 24 which transition into horizontal portions 25, which, in turn, transition into downward sloping portions 26 before joining in the finger grip portion 27 of the handle.

The hinged cover 11 has a knob 28 on its top side and a spring retaining tab 29 on its underside. At the rear of the feeder, a lighted on-off switch 32 and an "empty" light 33 and a "cycle" light 93 are mounted side by side. At the front of the feeder, under the hinged cover, a light-blocking soft rubber bumper 34 is mounted along the forward inner wall 35 and above the bumper spring loaded tab 36 is mounted in the inner wall to unlock the slide of the high speed magazine, by pressing against button 90 (See FIG. 3).

Figure 5:
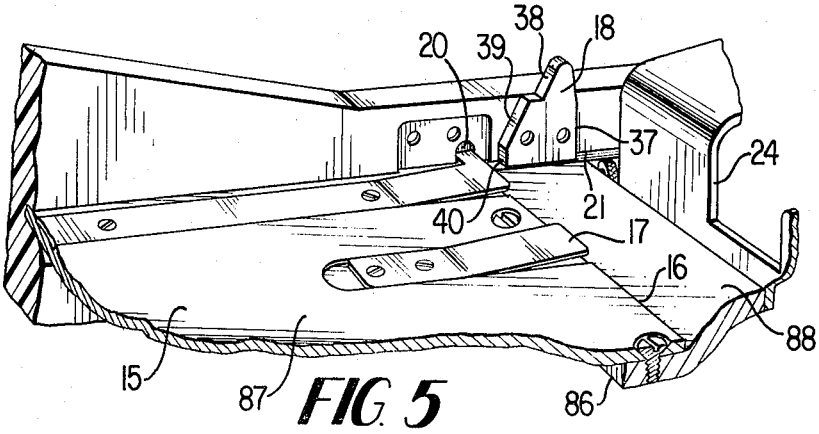
FIG. 5 is a view in perspective similar to FIG. 4, with the darkslide assembly closed.
Figure 4:
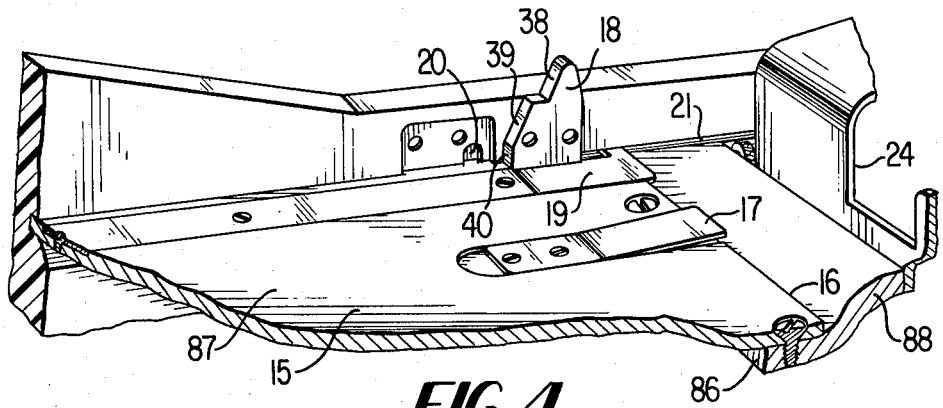
FIG. 4 is an enlarged view in perspective of a portion of the film handler, broken away to show the darkslide assembly partially open.

Referring to FIGS. 4 and 5, the block 18 is comprised of rear vertical surface 37, inclined forward surfaces 38, 39 and forward vertical surface 40. In the fully forward position of the darkslide (to the left, as shown in FIG. 5) the spring locking tab 19 is engaged in the locking slot 20 on the inner wall 22. When the locking tab 19 is pressed flush with the darkslide, the locking tab 19 can slide beneath the slot 20 and the block 18 and along the guide channel 21 so that the darkslide is unlocked to move towards the rear of the film feeder (to the right as shown in FIG. 4).

Figure 2:
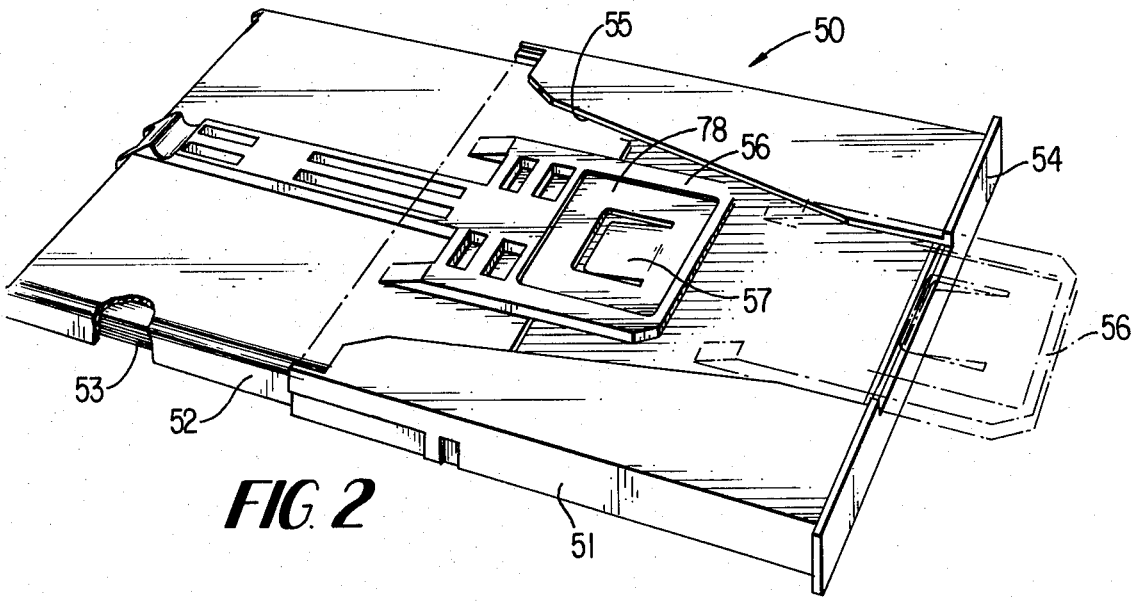
FIG. 2 shows a perspective view of a take up magazine with which the film handler interfaces. The view shows the two piece magazine in a partially open position and is cut away to show a number of 100×100 mm. exposed film sheets stored within the magazine.

FIG. 2 shows a film take up magazine 50, which consists of an outer portion 51 and an inner portion 52 which is open at the bottom. As shown at the cutaway portion, a stack 53 of exposed 100×100 mm. X-ray films lies exposed, face down, and ready to drop out of the magazine when the inner portion is slid out from the outer portion. The film magazine, which is made of plastic, has a back facing 54 and a generally tapering slot 55 on its upper face of its outer portion 51. The inner portion 52 has an end tab 56 which slides within the slot 55 in the closed and light-tight position and extends beyond the back face 54, as shown in phantom. When closed, the end of a spring locking tab 57 rests against the back face 54 and holds the magazine light-tight.

Figure 3:
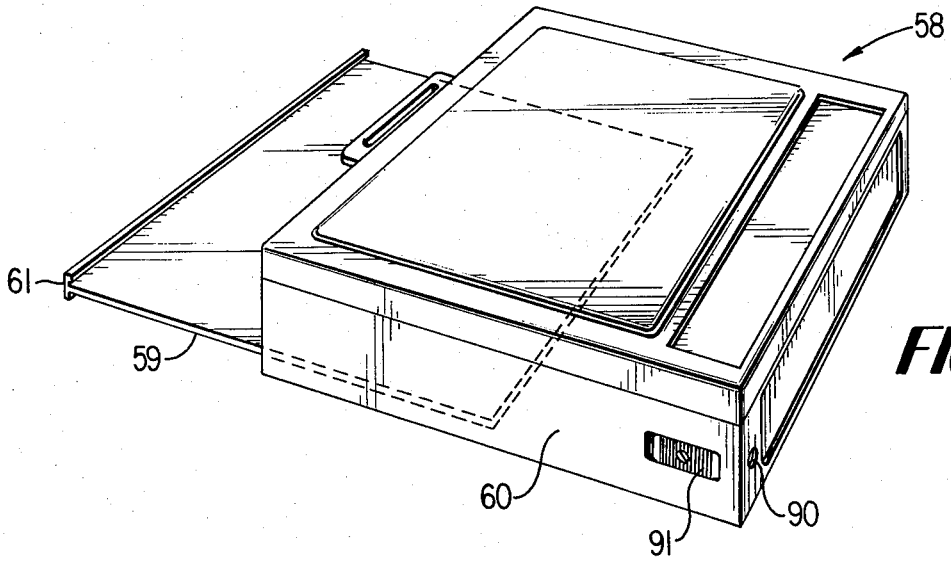
FIG. 3 shows a perspective view of a second design of a take up magazine for high speed cameras.

FIG. 3 shows another version of film take up magazine 58, for high speed cameras. An inner slide portion 59 is shown partially slid out from an outer cover portion 60. When the inner slide 59 is slid out a proper distance, a stack of exposed films (not shown) within the magazine would be in position to drop out the bottom of the magazine. The inner slide 59 has a flange 61 at its edge to slide it out of the outer cover 60, in a manner to be described. When closed, the lid will be light tight and held by locking mechanism activated by a button 90 or by fingergrip 91.

Figure 6:
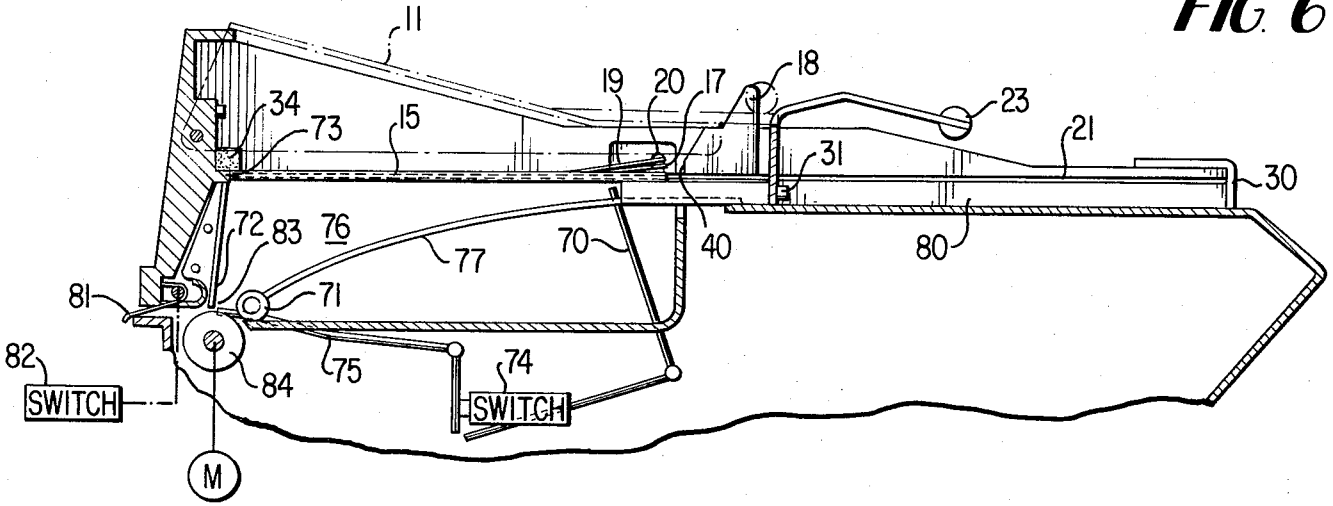
FIG. 6 is a cross-sectional view of the film handler.

The part of the X-ray film feeder at and above the darkslide 15 has been described, which relates, in the main to receiving a take up magazine. Next, with reference to FIG. 6, the part of the film feeder which is below the darkslide will be described. This part stores the film sheets after they have been discharged from the take up magazine and transports them, one at a time, in a light-tight manner, to the film processor.

Figure 8:
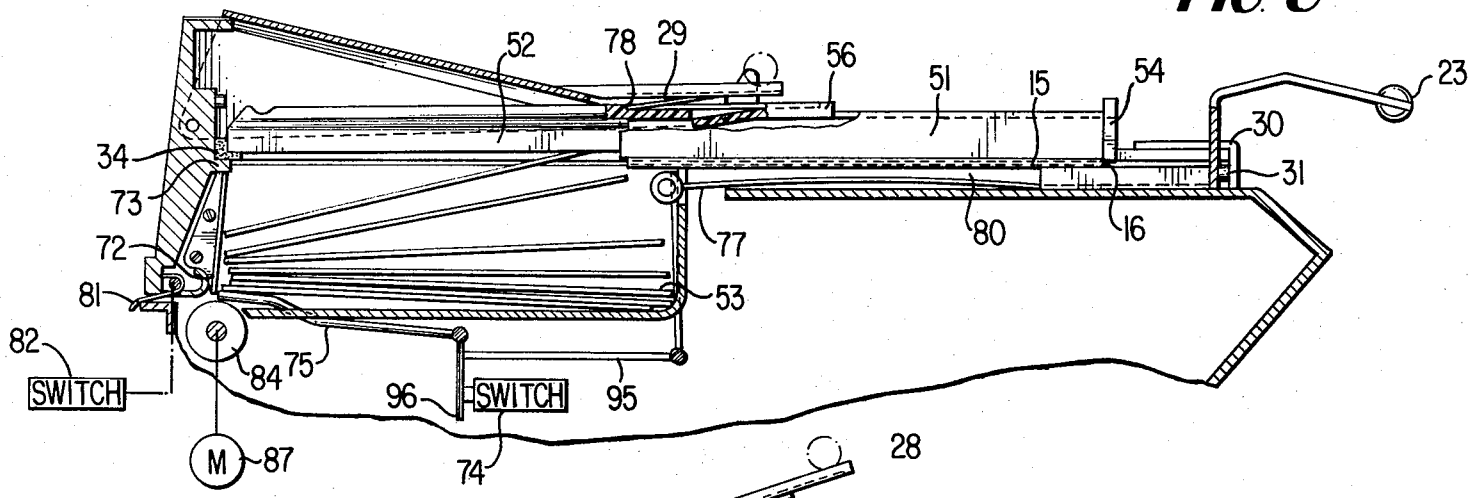
FIG. 8 is a cross-sectional view of the film handler similar to FIG. 6 with the darkslide pulled fully open.

Beneath the darkslide 15, a film cavity 76 is arranged at the forward end of the feeder. The roof of the cavity is sealed in a light-tight manner when the darkslide 15 rests fully forward and locked against the stop 73 and under the rubber bumper 34. Within the cavity 76 a roller arm 77 extends towards the cavity bottom and has film pressure rollers 71 thereon. When not in use, the roller arm is stored in roller arm compartment 80, as shown in FIG. 8. A film stacking bar 70 extends upwards into the cavity and is pivoted from below.

A switch sensor 75 also extends into the film cavity 76 from below and is connected to operate switch 74. At the forward lower end of the cavity (at the lower left in FIG. 6) a slotted opening 83 in the cavity is substantially closed off by a separator knife 72 arranged above a rubber roller 84. Forward of the rubber roller 84 at the discharge exit of the feeder, a switch sensor 81 completes the light-tight closure of the cavity 76 and is electrically connected to switch 82. Referring again to FIG. 1, the aligning roller 84 is driven by an endless belt 85 which in turn is driven by driving roller 86, powered by motor 87. A connector 88 is arranged at the rear of the feeder for connecting the feeder to an adjacent processor for synchronization of their operations.

Operation of the film feeder will now be described with additional reference to FIGS. 6–9. With the cover raised and the darkslide assembly 15 in the full forward and locked position (FIG. 1) a take up magazine is inserted forward of the handle. When the cover 11 is pivoted down over the magazine, with finger pressure on cover knob 28 on the top of the cover, the downward cover pressure on the magazine will depress the pair of locking tabs 19 at each side of the darkslide 15 into the guide channels 21 at the base of the locking slots 20. The darkslide is unlocked and ready to be drawn to the rear of the feeder, with the locking tabs 19 able to move beneath the block 18 and along the guide channel 21.

Figure 7:
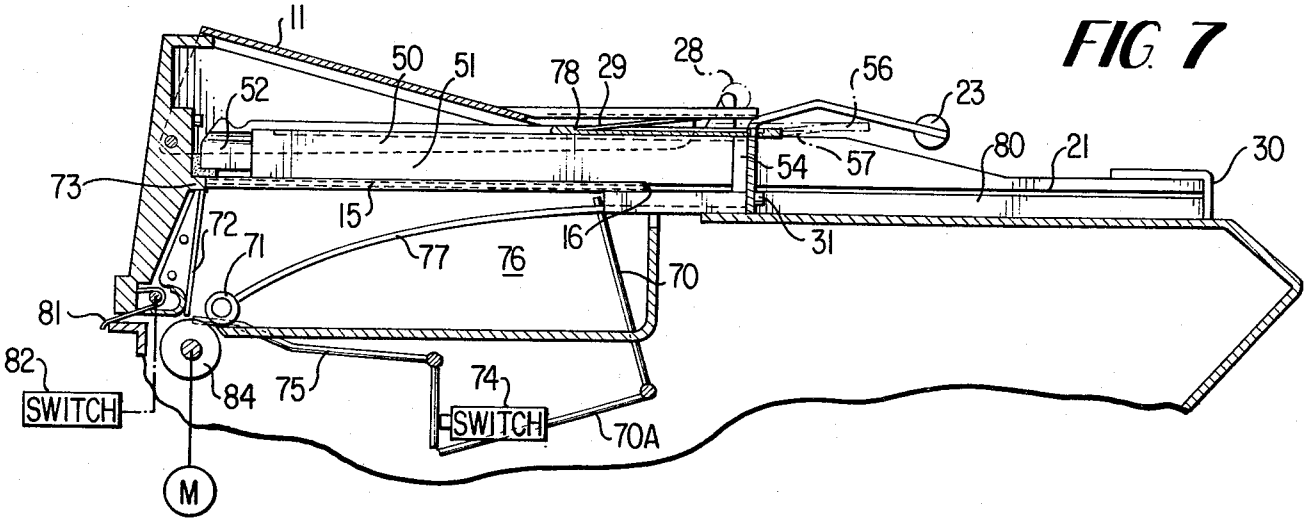
FIG. 7 is a cross-sectional view similar to FIG. 6 with a film take up magazine in position.

The magazine 50 is now in the position shown in FIG. 7. The forward end of the inner magazine portion 52 rests against the light-tight bumper 34, the ends of the back facing 54 rests between the blocks 18 and the vertical portion 24 of the handle. The bottom of the back facing 54 rests flush with the bottom of the darkslide 15 and ready to be engaged by the edge 16.

Then the spring locking tab 57 in the magazine end tab 56 is pushed up so that the magazine end tab 56 can be pushed from the extended position shown in phantom in FIGS. 2 and 7 to a position flush with the end of the hinge cover 11. In this position, the spring retaining tab 29 has dropped into and locks in the depression 78 in the top of the magazine end tab 56.

The handle 23 is pulled back as shown in FIG. 8 drawing the outer portion 51 of the take up magazine with it as the engagement edge 16 of the darkslide 15 engages behind and pushes the back face 54 of the outer magazine portion 51. The inner magazine portion 52 remains in place, held in place beneath the cover by the spring retaining tab 29 in the depression 78.

As the darkslide 15 moves back, the film cavity 76 is opened at the top. At the same time, the open underside of the inner magazine portion 52 is exposed, allowing the stack of film sheets to drop into the film cavity 76.

Figure 9:
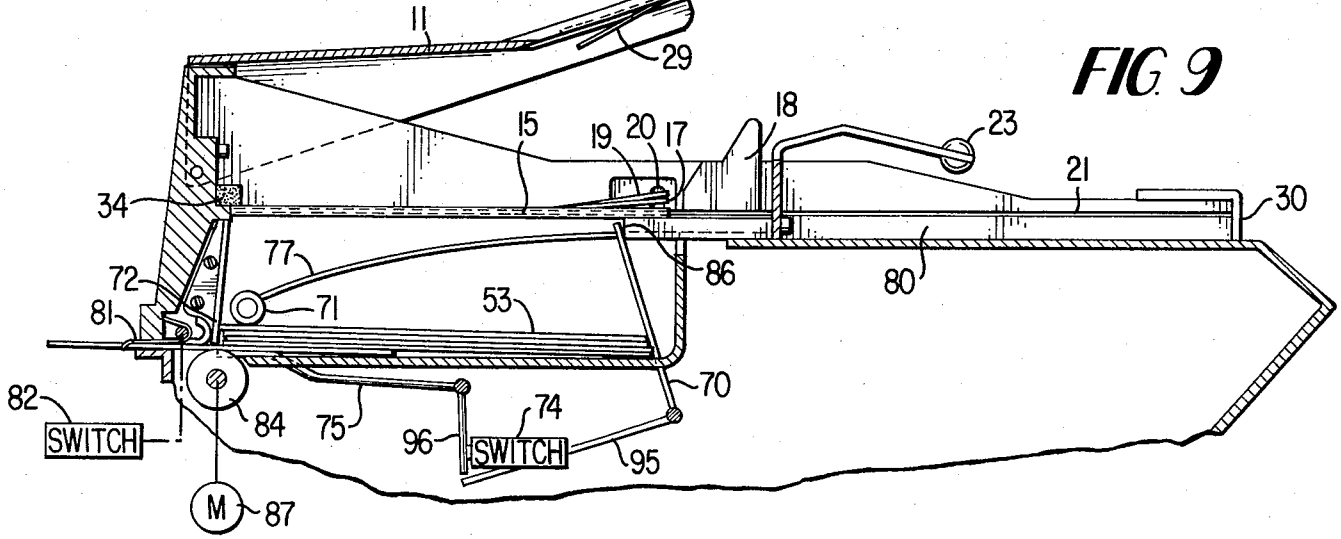
FIG. 9 is a cross-sectional view of the film handler similar to FIG. 6 showing the darkslide returned to a closed position.

Referring to FIG. 9, the handle 23 is then pushed forward and the darkslide assembly is closed and locked in a light-tight manner over the film cavity, by action of locking tabs 19 engaging with locking slots 20 at the inner walls of the feeder. The cover 11 can be opened and the now empty take up magazine can be removed from the film feeder and returned to the X-ray camera for further use.

As the darkslide assembly 15 moves forward the abutment 86 beneath the darkslide assembly 15 moves the film stacking bars 70 to align the film stack, and the film roller arm 77 is downward spring biased out from its compartment 80 onto the film stack to press the bottom film against the aligning roller 84.

The presence of the films is felt by the switch sensor 75 which activates the switch 74. This will switch off the empty neon light 33. Switch 32 starts the driven roller 84 in the counter clockwise direction, by virtue of belt 85, roller 106 and motor 87.

The separator knife 72 and the roller 84 are spaced to allow sufficient clearance to pass only one film through the exit at a time. The sensor 81 feels the presence of a single film at the transport exit and activates switch 82 indicating with neon light 93 that films are feeding into the processor. Spacing in between films will flash on and off neon light 93. The transport speed of the film sheets and the spacing between films is adjustable in order to be less than the speeds of different automatic film processors. The slower the speed, the greater the spacing. The transport speed is adjustable with a potentiometer reachable through a hole 105 in the rear cover. The spacing between films is time adjustable from 0.2 to 2 inches per second.

Also, the basic unit is designed to permit interchangeability of various exit forms and configurations to match various processes and process installations.

The light 33 goes off when the switch 74 is activated by the presence of the stack of films in the film cavity 61. This means that the take up magazine 50 above the cavity is empty and the feeder is ready to receive another take up magazine for continued operation, while the film from the previous magazine is being transported to the adjoining processor.

After being unloaded from the magazine, the feeder transports the films singly to the exit 83 where it is picked up by a film processor for processing.

The 100 mm. sheet film feeder is light-tight to the exit point. The feeder is designed so as not to damage, scratch or stress the film in any manner that may cause artifacts on the processed film, which could have a dangerous result when the film is used for medical diagnosis. The slightest changes in shading can have important meaning to the medical expert. This is accomplished in a feeder as shown, which is 6 inches wide, $4\frac{1}{2}$ inches high, $8\frac{3}{4}$ inches in depth and weighs 6 pounds.

Operation of the feeder with respect to the high speed take up magazine 58 shown in FIG. 3 is as follows. The take up magazine 58 is inserted onto the darkslide assembly 15 with the hinged cover 11 open. The high speed magazine is higher and shorter than the standard magazine shown in FIG. 2. It is capable of holding up to 100 sheet films whereas the standard magazine will hold up to 20 film sheets. The high speed magazine 58 is inserted onto the darkslide, against the forward stop surface 92 and the darkslide of the magazine is released by tab 36. As it is inserted, the inclined faces 38, 39 of the blocks 18 provide positioning assistance. When the magazine is fully inserted, the vertical face 40 of the blocks 18 serve as stops and prevent the cover portion 60 of the magazine from moving to the rear. In this position, the lower end flange 61 of the magazine slide 59 is engaged by the ends of the spring engagement tabs 17 on the darkslide 15. Then when pressure is applied to the lid, the handle 23 is pulled to the rear, the slide 59 is pulled to the rear with it and opens the cover 60 at its underside, allowing the films to fall into the cavity 76. Thereafter the operation is the same as with the standard magazine 50.

The cavity exit closure, the film transport mechanism in the cavity and the light-tight exit interface will now be described with reference to FIGS. 10 through 12.

Figure 10:
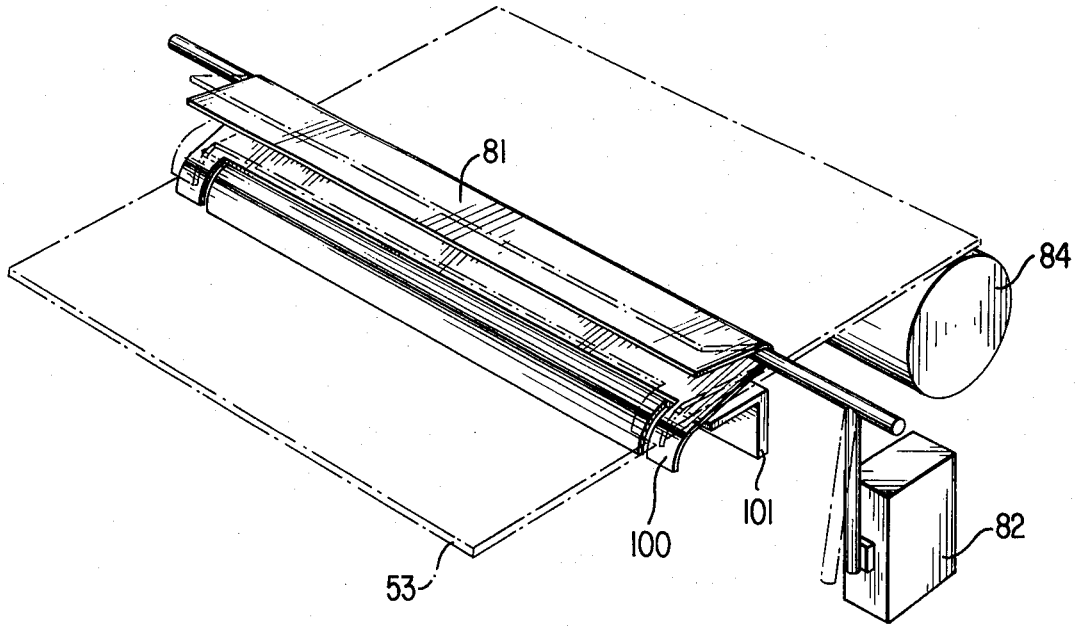
FIG. 10 is a perspective view of the cavity exit closure.

Referring to FIG. 10, a curved member 81 serves both as a switch sensor and provides a light-tight closure. The lower portion of member 81 is upon a strip of light-tight material on lower stationary part 101 which is secured at the cavity exit. Sensing fingers 100 extend at both sides of the lower portion. The curved member 81 is pivoted to activate the switch 82 when a single film sheet is transported through the exit closure, pushing sensing fingers 100 upward and opening the lower portion of member 81. The upper portion of curved member 81 moves up and down in a slot in the forward wall of the feeder to provide a light barrier.

Figure 11:
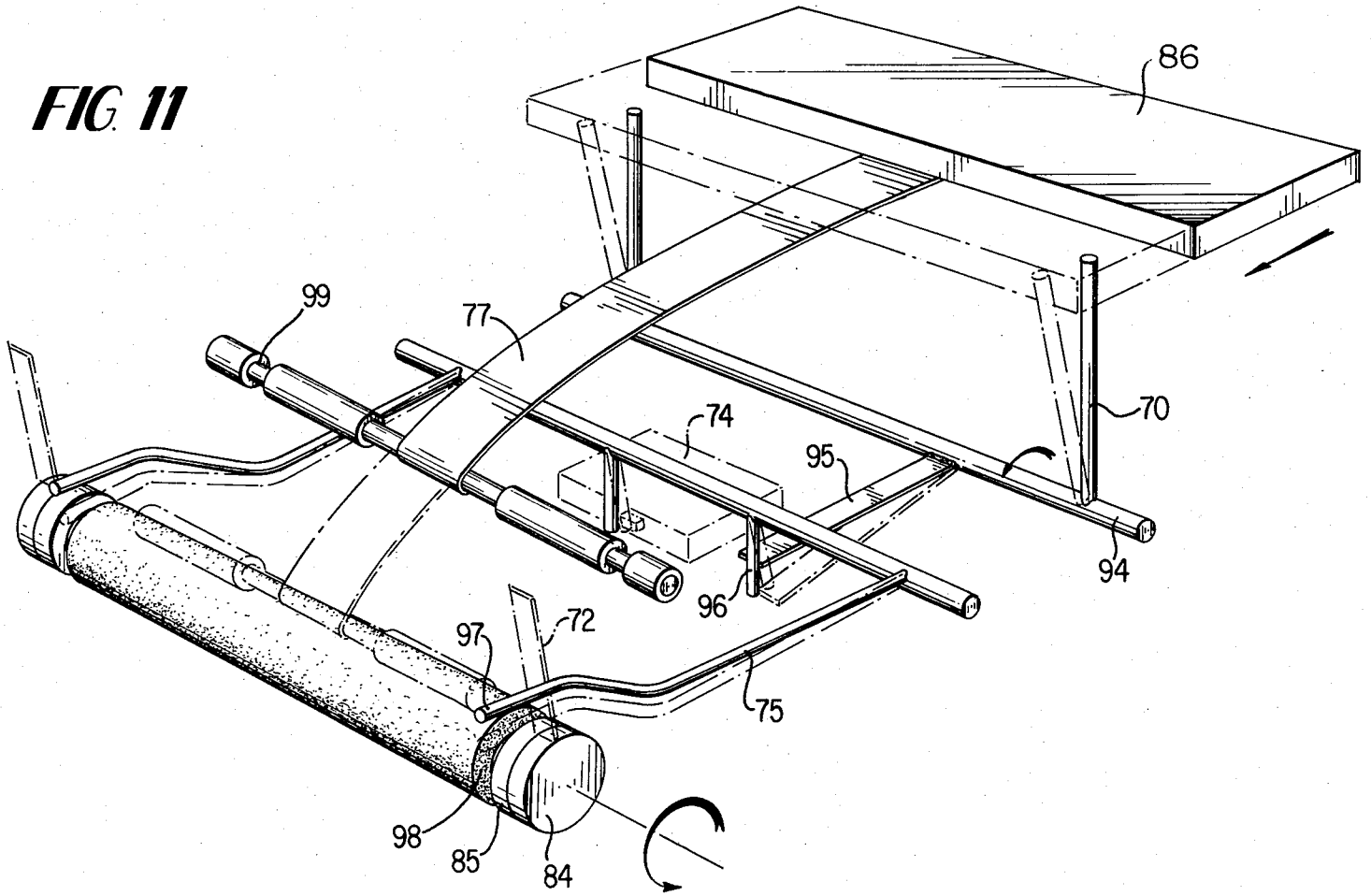
FIG. 11 is a perspective view of the transport mechanism for feeding the film sheets to an adjacent processor.

Referring to FIG. 11, the arm 77 extends from the darkslide into the cavity and carries the rollers 71 with grooves 99. The arm is spring biased in the downward direction, to apply downward pressure upon a stack of film sheets in the cavity. The stacking arms 70 are pivoted at 94 in the cavity upon the urging of the underside 86 of the darkslide. An arm 95 extends from the pivot member 94 to engage and activate forward movement of an arm 96 which is pivotably connected with sensing arm 75 which extends into the cavity and is normally biased downward. The forward portion of sensing arm 75 terminates in an upward jogged end portion 97 which, in its lowermost position fits into a groove 98 formed between the main body of rubber roller 84 and its metal roller end portion 85. The metal roller end portions 85 of the rollers 84 cooperate with the ends of separator knife 72 (shown in dotted line) to provide the proper spacing to permit only a single film sheet to be transported from the cavity at a time. The position of the separator knives 72 can be adjusted at distance from metal roller 85 of more than 1 and less than two thicknesses of the film sheet.

In operation, the transport mechanism also provides an interlock which prevents two or more film sheets from misfeeding at the exit, so that only the bottom sheet will exit from the cavity rather than the sheet above it.

As shown in FIG. 8, when the darkslide is fully withdrawn and the stack of film sheets are dropping into the cavity, the arm 75 extends into the cavity and the end portion 97 of the arm 75 keeps the forward portion of the lowest film resting on it. Without this precaution, it is possible, on occasion that the second lowest film and not the lowest one would be positioned to exit the cavity first. As shown in FIG. 9, when the darkslide is closed over the cavity and the lower edge 86 of the darkslide forces the stacking arms inward to push the film sheets against the knife 72, the arm 96 is released by the arm 95 and is free to follow its natural bias rearward. The end portion 97 of the arm 75 will drop into the roller groove 98 and the lowest film in the stack will rest upon the roller, ready to be transported through the exit cavity.

Figure 12A:
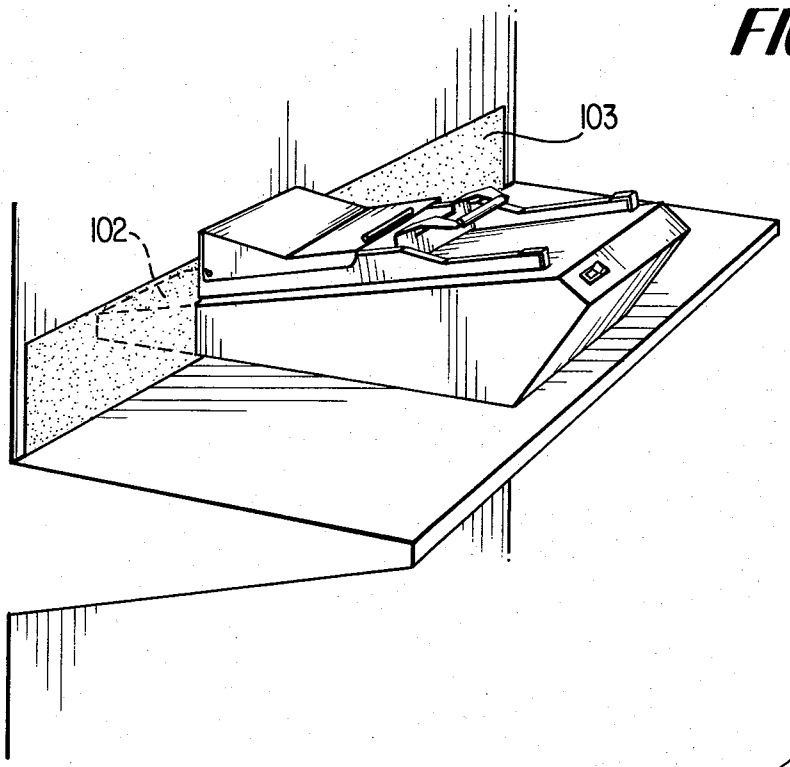
FIG. 12A is a perspective view of a film feeder positioned against a film processor with a light-tight interface.
Figure 12B:
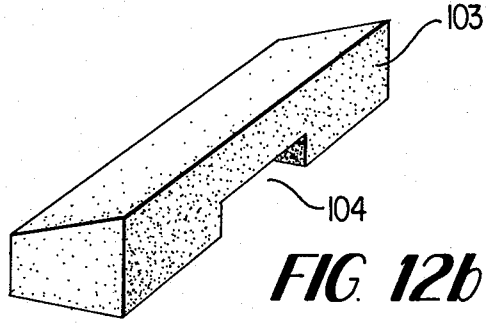
FIG. 12B is a perspective view of the foam block light tight interface shown in FIG. 12A.

Referring to FIGS. 12A and 12B, the film feeder interfaces in a light-tight manner with an adjacent film processor. In this embodiment an extender 102 is attached to the film feeder at the cavity exit to carry the film in a light-tight manner to the film processor input, after it has been fed from the film feeder. The extender 102 is not required for use with all processors. The extender fits into an opening 104 in a foam block 103 and the forward end of the feeder rests against the foam block to provide a light-tight interface between the film feeder and the film processor.

We claim:

1. A film feeding device for receiving a stack of individual film sheets and feeding the sheets individually to a film processor comprising:

a holder for receiving and holding a film storing magazine, a cavity below said holder, said cavity having an upward opening for receiving a stack of film sheets from the film storing magazine and an exit opening for discharging said film sheets, a planar slide in the holder, between the magazine and the cavity for opening the film storing magazine in a light-tight manner and for opening said upward cavity opening in a light-tight manner, means for moving said planar slide from between the magazine and the upward cavity opening, a closure for closing said cavity exit in a light-tight manner, a powered roller below the cavity at the cavity exit opening, rotatable in the direction of the cavity exit opening, a stacking arm pivoted from below the cavity towards the interior of the cavity as the planar slide covers over the upward cavity opening, an arm and roller which moves into the cavity as the planar slide covers over the upward cavity opening, the powered roller having at least one annular groove therein, at least one arm pivotable in the cavity and having an end portion for supporting film sheets thereon, pivotable between a first position above the powered roller annular groove, blocking the path of the individual film sheets towards the light-tight exit closure, and a second position in the powered roller annular groove, and means activated by the stacking arm for pivoting the film supporting end portion into the powered roller annular groove, as the stacking arm pivots into the cavity interior.

2. A film feeding device according to claim 1 in which a blade at the cavity exit opening limits the space between itself and the roller to about the thickness of an individual film sheet.

3. A film feeding device for receiving a stack of individual film sheets and feeding the sheets individually to a film processor comprising:

a holder for receiving and holding a film storing magazine, a cavity below said holder, said cavity having an upward opening for receiving a stack of film sheets from the storing magazine and an exit opening for discharging said film sheets, a planar slide in the holder, between the magazine and the cavity for opening the film storage magazine in a light-tight manner and for opening said upward cavity opening in a light-tight manner, means for moving said planar slide from between the magazine and the upward cavity opening, a closure for closing said cavity exit in a light-tight manner, transport means associated with said cavity for moving the film sheets individually through said exit closure, a first sensor which senses the presence of film sheets in said cavity, a first switch connected to said first sensor for relaying the film-sensed condition, a first visual indicator connected to said first switch for visually indicating the film-sensed condition, a second sensor which senses the opening of said cavity exit closure by the transport of an individual film sheet, a second switch connected to said second sensor for relaying the closure opening condition, and a second visual indicator connected to said second switch for indicating the closure opening condition.

4. A film feeding device for receiving a stack of individual film sheets and feeding the sheets individually to a film processor comprising:

a holder for receiving and holding a film storing magazine, a cavity below said holder, said cavity having an upward opening for receiving a stack of film sheets from the storing magazine and an exit opening for discharging said film sheets, a planar slide in the holder, between the magazine and the cavity for opening the film storage magazine in a light-tight manner and for opening said upward cavity opening in a light-tight manner, means for moving said planar slide from between the magazine and the upward cavity opening, a closure for closing said cavity exit in a light-tight manner, transport means associated with said cavity for moving the film sheets individually through said exit closure, a cover hinged over said slide, a downward biased spring tab on the underside of said cover, said spring tab being arranged to engage and retain a first part of a two-part film magazine of first type for retaining the stack of films over said cavity.

a first engagement means on said slide for drawing a second part of said two-part magazine from under its first part to release the film stack as said cavity is opened by movement of said slide, said first engagement means comprising a step in said slide for engaging behind a downward projecting portion on said second part, a second engagement means on said slide for drawing a second part of a two-part film magazine of a second type from under its first part, said second engagement means comprising an upward biased spring on said slide for engaging behind a downward projecting portion of said second part of said second magazine type, and a pair of stops at the sides of the holder, each having a pair of stop faces in opposite directions in which the stop faces in one direction engage sideways projecting portions of said second part of said two-part magazine of the first type when the magazine is fully received in the holder and the stop faces in the opposite direction engage said first part of said two-part magazine of the second type when the magazine is fully received in the holder.

5. A film feeding device for receiving a stack of individual film sheets and feeding the sheets individually to a film processor comprising:

a holder for receiving and holding a film storing magazine, a cavity below said holder, said cavity having an upward opening for receiving a stack of film sheets from the film storing magazines and an exit opening for discharging said film sheets, a planar slide in the holder, between the magazine and said cavity for opening the film storing magazine in a light-tight manner and for opening said upward cavity opening in a light-tight manner, means for moving said planar slide from between the magazine and said upward cavity opening, a closure for closing said cavity exit in a light-tight manner, and transport means associated with said cavity for moving the film sheets individually through said exit closure, said transport means comprising a powered roller below said cavity at said cavity exit opening, rotatable in the direction of said cavity exit opening, a stacking arm pivoted from below said cavity towards the interior of said cavity as said planar slide covers over said upward cavity opening, and an arm and roller which moves into said cavity as said planar slide covers over said upward cavity opening.

6. A film feeding device according to claim 4 comprising grooves in the sides of the holder for guiding the slide for opening and closing over said upward cavity opening and means for locking said slide in the closed position, said locking means comprising a locking slot opening into the groove and an upward biased spring tab movable between said locking slot and said groove.

7. A film feeding device according to claim 1, 3 or 5, comprising an interface device at the cavity exit opening providing a light tight contact with the input to an adjoining film processor.

8. A film feeding device according to claim 5 comprising means for adjusting the speed of transport of the roller to a speed less than the input speed of an adjoining processor.

9. A film feeding device according to claim 1 or 5 in which a blade at the cavity exit opening limits the space between itself and the roller to about the thickness of an individual film sheet.

10. A film feeding device according to claim 1 or 5 comprising a sensor which senses the presence of film sheets in the cavity and a switch connected to the sensor for relaying the film-sensed condition.

11. A film feeding device according to claim 1 or 5 comprising a sensor which senses the opening of the cavity exit closure by the transport of an individual film sheet and a switch connected to the sensor for relaying the timing of the film feeder.

* * * * *